US006193462B1

(12) United States Patent
Kubota

(10) Patent No.: US 6,193,462 B1
(45) Date of Patent: Feb. 27, 2001

(54) THRUST BALANCE DEVICE

(75) Inventor: Yasushi Kubota, Tokyo (JP)

(73) Assignee: Nikkiso Co., Ltd. (JP)

( * ) Notice: Subject to any disclaimer, the term of this patent is extended or adjusted under 35 U.S.C. 154(b) by 0 days.

(21) Appl. No.: 09/295,162

(22) Filed: Apr. 20, 1999

(30) Foreign Application Priority Data

Apr. 8, 1998 (JP) ..... 11-100932
Apr. 20, 1998 (JP) ..... 10-109720

(51) Int. Cl.[7] ..... F01D 3/04
(52) U.S. Cl. ..... 415/106; 415/104; 415/107
(58) Field of Search ..... 415/101, 104, 415/105, 106, 107, 96, 97

(56) References Cited

U.S. PATENT DOCUMENTS 3,664,758 * 5/1972 Sato ..... 415/104
3,874,812 * 4/1975 Hanagarth ..... 415/106

FOREIGN PATENT DOCUMENTS 7-35090 2/1995 (JP) .
9-42190 2/1997 (JP) .
10-68396 3/1998 (JP) .

* cited by examiner

*Primary Examiner*—Edward K. Look
*Assistant Examiner*—Richard Woo
(74) *Attorney, Agent, or Firm*—Morrison Law Firm

(57) ABSTRACT

A flow channel and pressure equalizing sections introduce a fluid having substantially no angular momentum into a thrust balance chamber of a thrust balance device. The introduction of this fluid reduces the angular momentum of the fluid in the thrust balance chamber, facilitating the discharge of fluid out of the thrust balance chamber through a variable orifice. The thrust balance chamber exerts a variable pressure onto a rear surface of an impeller of a centrifugal pump. This pressure prevents significant displacement of the impeller during pump operation. The result is a centrifugal pump having good thrust balance properties regardless of flow rate and impeller speed.

12 Claims, 3 Drawing Sheets

THRUST BALANCE DEVICE

BACKGROUND OF THE INVENTION

The present invention relates to a thrust balance device. More specifically, the present invention relates to a thrust balance device significantly improving thrust balance in a device such as a canned motor pump.

Conventional canned motor pumps include an impeller mounted on a rotating shaft. In this type of canned motor pump, a fluid is suctioned through a suction opening which faces the rotating shaft. Centrifugal force from the impeller causes discharge of the suctioned fluid from radial discharged openings. Since the suction opening is oriented toward the rotation shaft, a force is applied on the impeller in the direction of thrust. Thus, in primitive canned motor pumps, the impeller is pushed toward an inner wall of the chamber holding the impeller. This pushing force interferes with the rotation of the impeller. As a result, almost all recent canned motor pumps are equipped with a thrust balance mechanism.

Suction of the fluid generates a pressure in the direction of thrust. A thrust balance mechanism prevents obstruction of the rotation of the impeller caused by the pressure of the suctioned fluid. Generally, thrust balance mechanisms include:

(1) a fixed orifice wherein a ring-shaped cylinder is formed on a rear surface of an impeller having a balance hole. The ring-shaped cylinder is inserted into a cavity which has a cylindrical inner perimeter surface disposed on a casing. The result is a gap formed between the outer perimeter surface of the cylinder and the cylindrical inner perimeter surface of the cavity;

(2) a thrust balance chamber which is formed from the following: a bottom surface of the cylinder; an inner perimeter surface of the cylinder; a surface of a first projection projected from the casing toward an inner space of the cylinder, this first surface facing the bottom surface and being separated from the bottom surface by a prescribed gap; and an outer perimeter surface of a ring-shaped second projection, surrounding the rotor, projecting further than the first projection;

(3) a variable orifice which is formed from an end surface of the second projection facing the rear surface of the impeller and the rear surface of the impeller.

In the conventional thrust balance mechanism, the centrifugal force from the rotation of the impeller causes fluid to be discharged radially. A portion of the fluid discharged in the centrifugal direction flows into the thrust balance chamber via the fixed orifice. The fluid which enters the thrust balance chamber flows out from the thrust balance chamber through the variable orifice. The fluid exiting the thrust balance chamber passes through the balance hole and combines with the discharged fluid.

If the pressure of the suctioned and discharged fluid increases, a pressure in the direction of thrust is applied to the impeller. This pressure causes the back surface of the impeller to approach the casing surface facing the back surface of the impeller. However, pressure from the fluid also increases the flow rate, resulting in higher fluid pressure within the thrust balance chamber. The increase in fluid pressure in the thrust balance chamber causes a pressure to be applied on the impeller from the casing facing the rear surface of the impeller, pushing it away. This pressure is sometimes referred to as independent pressure. Fluid pressure within the thrust chamber causes the impeller to move against the pressure from the fluid being suctioned and discharged.

The gap in the variable orifice increases when the impeller is displaced away from the casing facing its rear surface, i.e., when the impeller is shifted so that it moves away from the casing surface facing the rear surface of the impeller. This movement causes high-pressure fluid to suddenly flow from the variable orifice. As a result, fluid pressure within the thrust balance chamber drops. The pressure in the thrust direction applied to the impeller from the fluid being suctioned and discharged becomes greater than the fluid pressure within the thrust balance chamber. The pressure in the thrust direction causes the impeller to shift toward the casing surface facing the rear surface of the impeller.

As described above, in order to balance the pressure within the thrust balance chamber and the pressure from the fluid being suctioned and discharged, the impeller changes its position based on the gap in the fixed orifice, the gap in the variable orifice, as well as the volume of the thrust balance chamber. The change of position of the impeller maintains balance for the rotor along the thrust direction.

However, with thrust balance chamber in conventional thrust balance devices, the rear surface of the impeller is a rotation surface, while the casing surface facing the impeller is a fixed surface. Thus, fluid flowing into the thrust balance chamber receives an angular momentum energy from the impeller rotation. Additionally, fluid flowing into the thrust balance chamber rotates together with the impeller. As a result, a very high flow-path resistance is generated in the thrust balance chamber by the fluid rotating with the impeller.

The flow-path resistance of the fluid interposed between the rotation surface and the fixed surface is proportional to the square of the peripheral speed of the fluid rotating with the rotation surface. Thus, a large amount of fluid is present in the gap between the fixed surface and the rotation surface, especially in high-speed pumps where the impeller rotation speed is very high. Furthermore, the flow-path resistance of fluid in the thrust balance chamber becomes large in large pumps where the peripheral speed of the rotating fluid is high, preventing the thrust balance from being maintained appropriately.

In order to overcome this problem, bypass structures known as pressure-equalizing holes or pressure-decreasing holes have been conventionally formed in the fixed surface of the thrust balance chamber. However, these pressure-equalizing holes have been unable to lower flow-path resistance and maintain thrust balance. While forming this kind of bypass may be able to increase the independent pressure, this kind of bypass cannot significantly reduce the angular momentum of the fluid inside the thrust chamber.

OBJECTS AND SUMMARY OF THE INVENTION

It is an object of the present invention to provide a thrust balance device which overcomes the foregoing problems.

It is another object of the present invention to provide a thrust balance device which has superior thrust balance properties.

It is a further object of the present invention to provide a thrust balance device which has good thrust balance properties regardless of pump discharge rate.

It is still a further object of the present invention to provide a thrust balance device which has good thrust balance properties regardless of impeller rotation speed.

Briefly stated, the present invention provides a flow channel and pressure equalizing sections introducing a fluid having substantially no angular momentum into a thrust balance chamber of a thrust balance device. The introduction of this fluid reduces the angular momentum of the fluid in the thrust balance chamber, facilitating the discharge of fluid out of the thrust balance chamber through a variable orifice. The thrust balance chamber exerts a variable pressure onto a rear surface of an impeller of a centrifugal pump. This pressure prevents significant displacement of the impeller during pump operation. The result is a centrifugal pump having good thrust balance properties regardless of flow rate and impeller speed.

According to an embodiment of the present invention, there is provided a thrust balance device in a centrifugal pump comprising a fixed orifice permitting flow of a portion of a fluid passing through the centrifugal pump into a thrust balance chamber of the thrust balance device, the thrust balance chamber minimizing axial displacement of an impeller of the centrifugal pump, a variable orifice permitting a variable flow of the portion from the thrust balance chamber depending on a balance between a fluid pressure between the thrust balance chamber and a fluid being pumped, and means for introducing a second fluid, having substantially no angular momentum, into the thrust balance chamber, whereby the second fluid facilitates flow of the portion and second fluid through the variable orifice.

According to another embodiment of the present invention, there is provided a thrust control device for controlling an axial position of an impeller of a centrifugal pump, comprising the impeller having a first surface exposed to a pressure of a fluid being pumped, a thrust balance chamber adjacent a second surface of the impeller, at least one balance hole communicating between the first and second surfaces, a projection facing the at least one balance hole, a fixed orifice permitting a controlled leakage of the fluid from an outlet of the centrifugal pump into the thrust balance chamber, the projection being positioned to block communication the first and second surfaces when the impeller is displaced axially a predetermined distance in a first direction, whereby the controlled leakage is enabled to increase a fluid pressure in the thrust balance chamber, and thereby to resist axial displacement of the impeller in said first direction, and at least one stationary flow channel conveying a portion of the fluid with substantially reduced angular momentum to the thrust balance chamber.

According to still another embodiment of the present invention, there is provided a device for feeding fluid having substantially no angular velocity to a balance chamber of a centrifugal pump comprising a radially arranged opening for accepting the fluid at a larger radius and conducting the fluid to a smaller radius, the radially arranged opening having a first cross-sectional area, an outlet receiving the fluid at said smaller radius, and feeding the fluid into the balance chamber, the outlet having a second cross-sectional area at its outlet to the balance chamber, and the first cross-sectional area being less than the second cross-sectional area.

The present invention achieves these objects by providing a thrust balance device that includes the following elements.

(1) A fixed orifice forming a gap between an outer perimeter surface of a cylinder and a cylindrical inner perimeter surface of a cavity in the casing of the pump. The fixed orifice has a balance hole wherein a cylinder formed on a rear surface of an impeller mounted on a rotor is inserted into a cavity disposed in a casing.

(2) A thrust balance chamber which is formed from the following: a base surface of the cylinder; an inner perimeter surface of the cylinder; a surface of a first projection projected from the casing toward an inner space of the cylinder, the surface being separated from the base surface by a prescribed gap; and an outer perimeter surface of a ring-shaped second projection, surrounding the rotor, projecting further than the first projection.

(3) A variable orifice which is formed between an end surface of the second projection facing a bottom surface of the impeller and the bottom surface of the impeller.

(4) A ring-shaped groove, surrounding the rotor, which is formed on the first projection.

(5) A pressure-equalizing section which is continuous with the ring-shaped groove and the cavity.

Preferably, the thrust balance device described above has a pressure equalizing section with a cross-sectional area in a direction perpendicular to an axis of the pressure-equalizing section greater than the total opening area of the balance hole. Even more preferably, the opening area of the first projection of the ring-shaped groove of the thrust balance device described above has an area greater than the total opening area of the balance hole.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
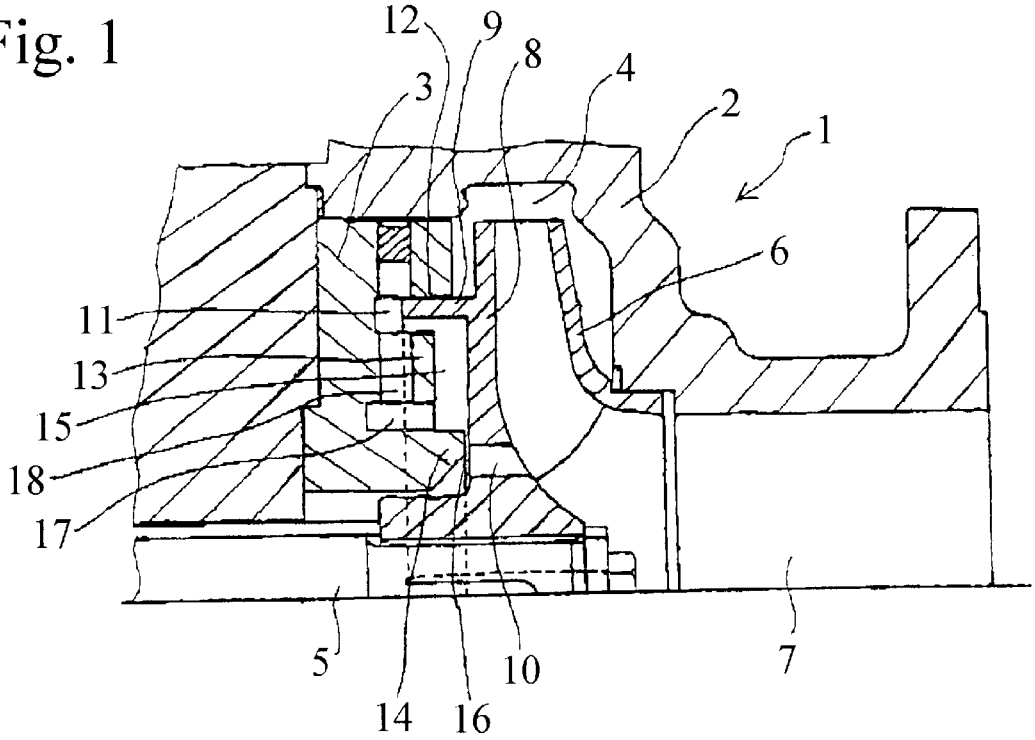
FIG. 1 is a vertical cross-section drawing of a thrust balance device of one embodiment of the present invention.

Referring to FIG. 1, a centrifugal pump 1 equipped with a thrust balance device according to the present invention includes an impeller 6 mounted on a rotor 5. Impeller 6 is positioned in a pump chamber 4 formed by a casing 2 and a linear disk 3.

A suction opening of centrifugal pump 1 (not shown) is formed at an axial orientation relative to impeller 6. A cylindrical guide path 7, co-axial with rotor 5, extends from the suction opening to pump chamber 4.

Impeller 6 includes a base 8 which has a circular shape when seen from an axial direction. Impeller 6 rotates together with rotor 5, discharging fluid guided in a circumferential direction by a guide path 7. Thus, in centrifugal pump 1, a discharge opening (not shown) is formed circumferentially from impeller 6.

A cylinder 9 projects from a rear surface, i.e., the surface facing linear disk 3, of base 8, which is a section of impeller 6. Cylinder 9 projects toward liner disk 3. Furthermore, a balance hole 10 extends from the rear surface of base 8 toward guide path 7.

A cavity 11 is formed on a surface of linear disk 3 facing base 8. Cavity 11 has a cylindrical inner perimeter surface which has an inner diameter slightly larger than a diameter of cylinder 9. When cylinder 9 is inserted into cavity 11, a slight gap is formed between an outer perimeter surface of cylinder 9 and an inner perimeter surface of cavity 11. This gap serves as a fixed orifice 12.

A disc-shaped first projection 13, on cavity 11 inward from cylinder 9, projects toward a rear surface of impeller 6. A second projection 14, having a ring-shaped end surface, is located on cavity 11 at a position inward from first projection 13, toward rotor 5. Second projection 14 projects closer to the rear surface of impeller 6 than first projection 13. An end surface of first projection 13 facing a bottom surface of cylinder 9 has a ring shape. When cylinder 9 is inserted into cavity 11, a prescribed gap is formed between an outer perimeter surface of first projection 13 and an inner perimeter surface of cylinder 9. This gap is much larger than the gap formed by fixed orifice 12. The ring-shaped end surface of second projection 14 forms a ring when seen from an axial direction.

A thrust balance chamber 15 is located in a space created between the ring-shaped end surface of first projection 13 (this surface is also a fixed surface) and a bottom surface of cylinder 9 (this surface is the rear surface of impeller 6 and is also a rotating surface).

A variable orifice 16 is formed in a space between the ring-shaped end surface of second projection 14 and a bottom surface of cylinder 9, i.e., the rear surface of base 8.

A ring-shaped groove 17, centered around rotor 5, is positioned between first projection 13 and second projection 14. Ring-shaped groove 17 is formed in a space surrounded by an opening facing a ring-shaped end surface of first projection 13, an inward inner perimeter surface which is an outer perimeter surface of cylinder 9, and an outward inner perimeter surface which is an inner perimeter surface of cylinder 9. The resulting space is a ring-shaped space centered around rotor 5. A line representing a vertical cross-section edge of an inward inner perimeter surface of ring-shaped groove 17 (see FIG. 1) is parallel with a line representing a vertical cross-section edge of an outward inner perimeter surface of ring-shaped groove 17.

Pressure-equalizing sections 18 are openings extending from an outer perimeter surface of first projection 13 to ring-shaped groove 17. Pressure-equalizing sections 18 are continuous with ring-shaped groove 17 and cavity 11. Preferably, twelve pressure-equalizing sections 18 are formed on first projection 13. The pressure-equalizing sections have circular cross-sections parallel to an axis of rotation of rotor 5. In other words, pressure-equalizing sections 18 have cylindrical inner spaces.

The following is a description of how centrifugal pump 1 operates together with the thrust balance device of the present invention.

Rotor 5 rotates together with impeller 6. Fluid introduced from the suction opening (not shown) flows through guide path 7 into pump chamber 4. Since impeller 6 is rotating inside pump chamber 4, the fluid is discharged through a discharge opening (not shown) by centrifugal force. This is the standard operation of centrifugal pump 1.

A portion of the fluid in pump chamber 4 flows through fixed orifice 12, into thrust balance chamber 15. The fluid continues through variable orifice 16 and balance hole 10 to return to a front side of impeller 6.

If the discharge pressure toward on impeller 6 side increases, impeller 6 is displaced toward liner disk 3 by this increase in discharge pressure. This pressure change causes the opening of variable orifice 16 to be decreased, lowering the flow through variable orifice 16. While the space in variable orifice 16 decreases, the space in fixed orifice 12 remains unchanged. Thus, fluid continues to flow into thrust balance chamber 15, increasing the fluid pressure inside thrust balance chamber 15 until the fluid pressure in thrust balance chamber 15 exceeds the discharge pressure.

When the fluid pressure of thrust balance chamber 15 exceeds the discharge pressure, impeller 6 is displaced in the direction where cylinder 9 is pushed out from cavity 11. This displacement of impeller 6 increases the opening in variable orifice 16. As the opening in variable orifice 16 increases, the amount of fluid coming out through variable orifice 16 from balance chamber 15 exceeds the amount of fluid going into balance chamber 15 through fixed orifice 12. Thus, the fluid and fluid pressure in thrust balance chamber 15 is reduced, displacing impeller 6 toward linear disk 3. When the fluid pressure in thrust balance chamber 15 is in equilibrium with the discharge pressure toward impeller 6, displacement of impeller 6 stops.

Fluid inside thrust balance chamber 15 rotates together with the rotation of impeller 6. Fluid rotating inside thrust balance chamber 15 has an angular momentum and generates flow-path resistance. If this flow-path resistance is high, the flow of fluid in thrust balance chamber 15 out through variable orifice 16 is hindered, even when the opening in variable orifice 16 is increased.

An object of the present invention is to reduce the flow-path resistance caused by the angular momentum of the fluid in thrust balance chamber 15. Ring-shaped groove 17 and pressure-equalizing section 18 help achieve this goal. Fluid having no angular momentum flows from pressure-equalizing section 18 into thrust balance chamber 15 via ring-shaped groove 17, mixing with fluid having angular momentum. The addition of a fluid having no angular momentum into thrust balance chamber 15 dramatically reduces the angular momentum of fluid in thrust balance chamber 15. Thus, by reducing the flow-path resistance caused by angular momentum of fluid in thrust balance chamber 15, fluid in thrust balance chamber quickly and smoothly flows out through variable orifice 16.

A computer was used to simulate the thrust balance in rotor 5 for a pump having pressure-equalizing section 18 and ring-shaped groove 17 versus a pump having only pressure-equalizing section 18. According to the results of the simulation, the outgoing flow from variable orifice 16 was 290 liters/m for the pump having only pressure-equalizing section 18. The flow pressure at the back side of impeller 6 (the pressure inside thrust balance chamber 15) was 2383 N (241 kgf). With the pump having pressure-equalizing section 18 and ring-shaped groove 17, the outgoing flow from variable orifice 16 was 301 liters/m and the flow pressure at the back side of impeller 6 was 2157 N (220 kgf), thus showing a dramatic reduction in flow path resistance caused by angular momentum of fluid in thrust balance chamber 15. In these calculations the pump specifications were as follows: SUC 125 A, DIS 100 A, 200 $m^3/h \times 32$ m×2900 rpm, impeller diameter 190.

The structure of the groove space of ring-shaped groove 17 formed on first projection 13 can be of any shape, as long as it surrounds rotor 5.

Figure 2:
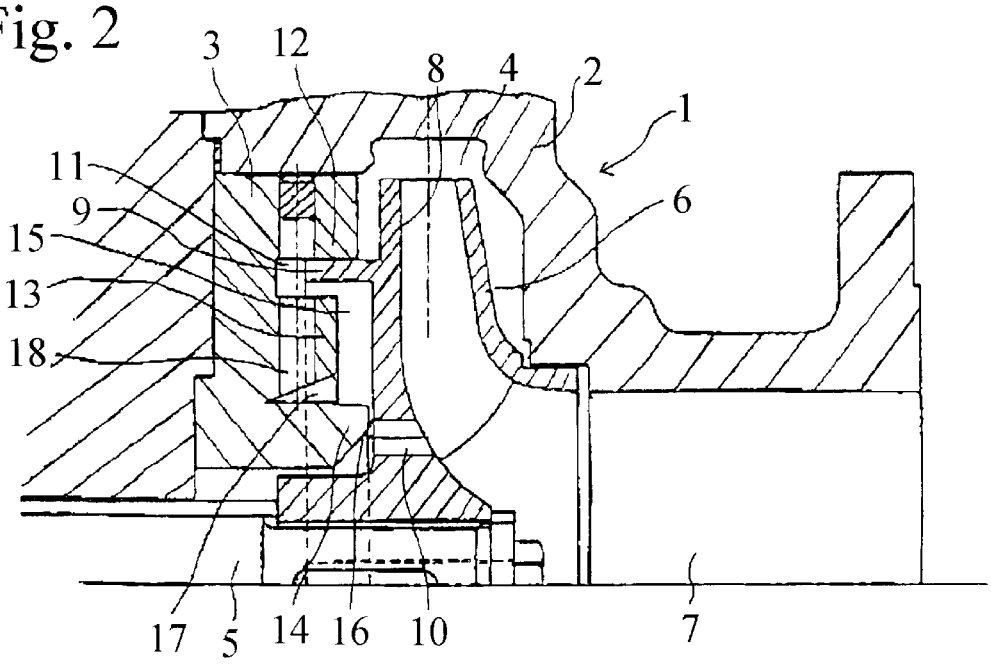
FIG. 2 is a vertical cross-section drawing of another embodiment of a thrust balance device of the present invention.

Referring to FIG. 2, an alternate embodiment of the present invention described above is shown. Ring-shaped groove 17 has a groove space surrounded by an opening facing the ring-shaped end surface of first projection 13, an inward inner perimeter surface co-axial to rotor 5 corresponding to an outer perimeter surface of cylinder 9, and an outward inner perimeter surface corresponding to an inner perimeter surface of a cone that is co-axial with rotor 5. The vertical cross-section of the groove space of ring-shaped groove 17 of this embodiment of the present invention forms a wedge shape.

Figure 3:
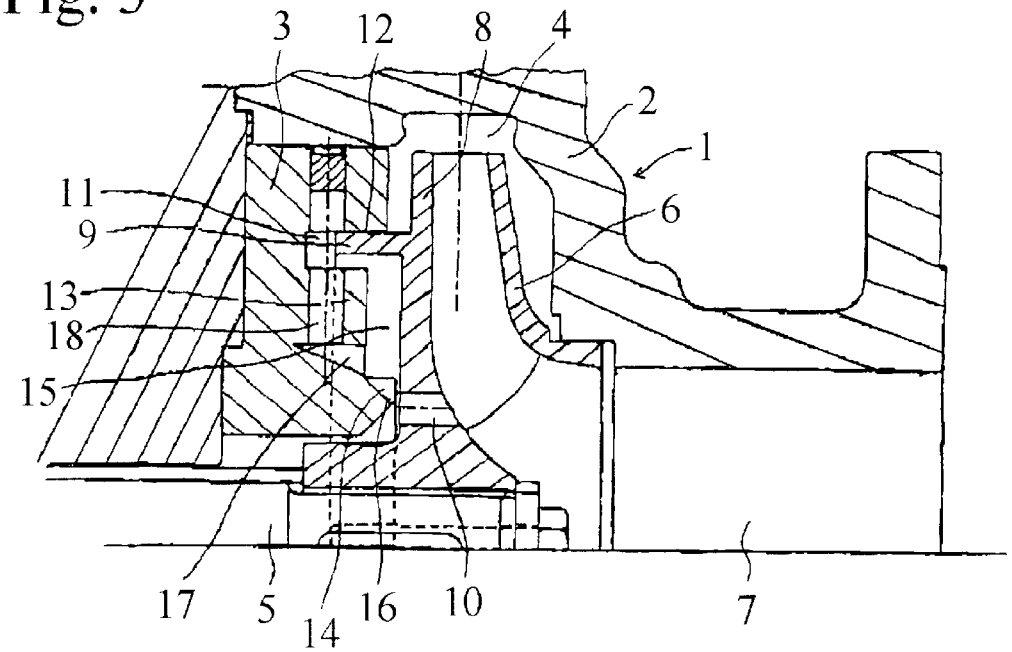
FIG. 3 is a vertical cross-section drawing of a thrust balance device of yet another embodiment of the present invention.

Referring to FIG. 3, an alternate embodiment of the present invention described above is shown. Ring-shaped groove 17 has a groove space surrounded by an opening facing a ring-shaped end surface of first projection 13, an inward inner perimeter surface corresponding to an outer perimeter surface of a cone that is co-axial with rotor 5, and an outward inner perimeter surface corresponding to an inner perimeter surface of a cone 9 that is co-axial with rotor 5. The vertical cross-section of the groove space of ring-shaped groove 17 of this embodiment of the present invention forms a wedge shape having a configuration opposite of the wedge shape of the embodiment described in FIG. 2.

Figure 4:
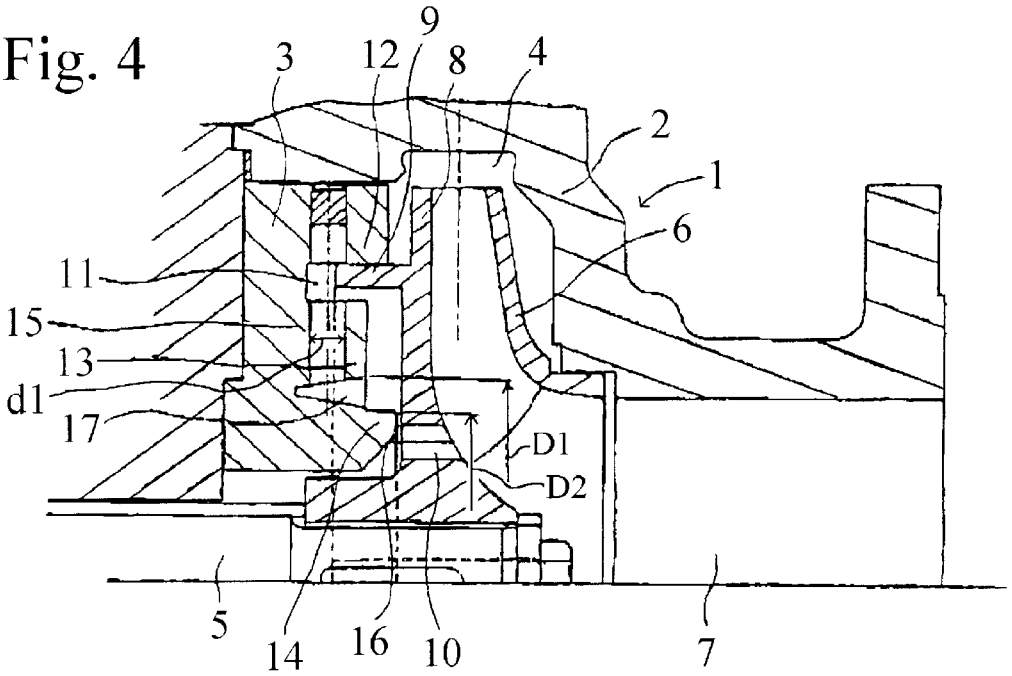
FIG. 4 is a vertical cross-section drawing of still another embodiment of a thrust balance device of the present invention.

Referring to FIG. 4, in yet another embodiment of the present invention, ring-shaped groove 17 has a groove space surrounded by an opening facing a ring-shaped end surface of first projection 13, an inward inner perimeter surface corresponding to an outer perimeter surface of a cone that is co-axial with rotor 5, and an outward inner perimeter surface of a cone that is co-axial with rotor 5. The vertical cross-section of the groove space of ring-shaped groove 17 of this embodiment of the present invention forms a v-shape.

Regardless of the shape of the groove space formed by ring-shaped groove 17, it is desirable for a total sum A of the circular cross-section areas of pressure-equalizing sections 18 (A is calculated as $n\times(\pi/4)\times d1^2$, where n is the number of pressure-equalizing sections 18 and d1 is the diameter of the circular cross-section) to be smaller than an area B of the opening of ring-shaped groove 17 (B is calculated as $(\pi/4)\times(D2-D3)^2$, where (D2–D3) is the diameter of the opening of ring-shaped groove 17), i.e., A<B.

Preferably, both the total area A of circular cross-sections of pressure-equalizing sections 18 and the opening area B of ring-shaped groove 17 are greater than the total opening area in base 8 of balance hole 10.

There are no special restrictions placed on the number of pressure-equalizing sections 18.

Embodiment 1

A thrust balance device having the structure as shown in FIG. 1 is installed on a canned motor pump (type: HN25E). The discharge flow was varied in a range of 10–140 $m^3$/hr. The difference between the fluid pressure within thrust balance chamber 15 and the discharge pressure at impeller 6, i.e., the residual thrust, was measured.

The thrust balance device of this embodiment of the present invention is formed on the canned motor pump with both the total area A of the circular cross-sections of pressure-equalizing sections 18 and the opening area B of ring-shaped groove 17 being greater than the total opening area in base 8 of balance hole 10. Furthermore, the total area A of the circular cross-sections of pressure-equalizing sections 18 is less than the opening area B of ring-shaped groove 17. The canned motor pump is rotated with an alternating current of 50 Hz.

Figure 5:
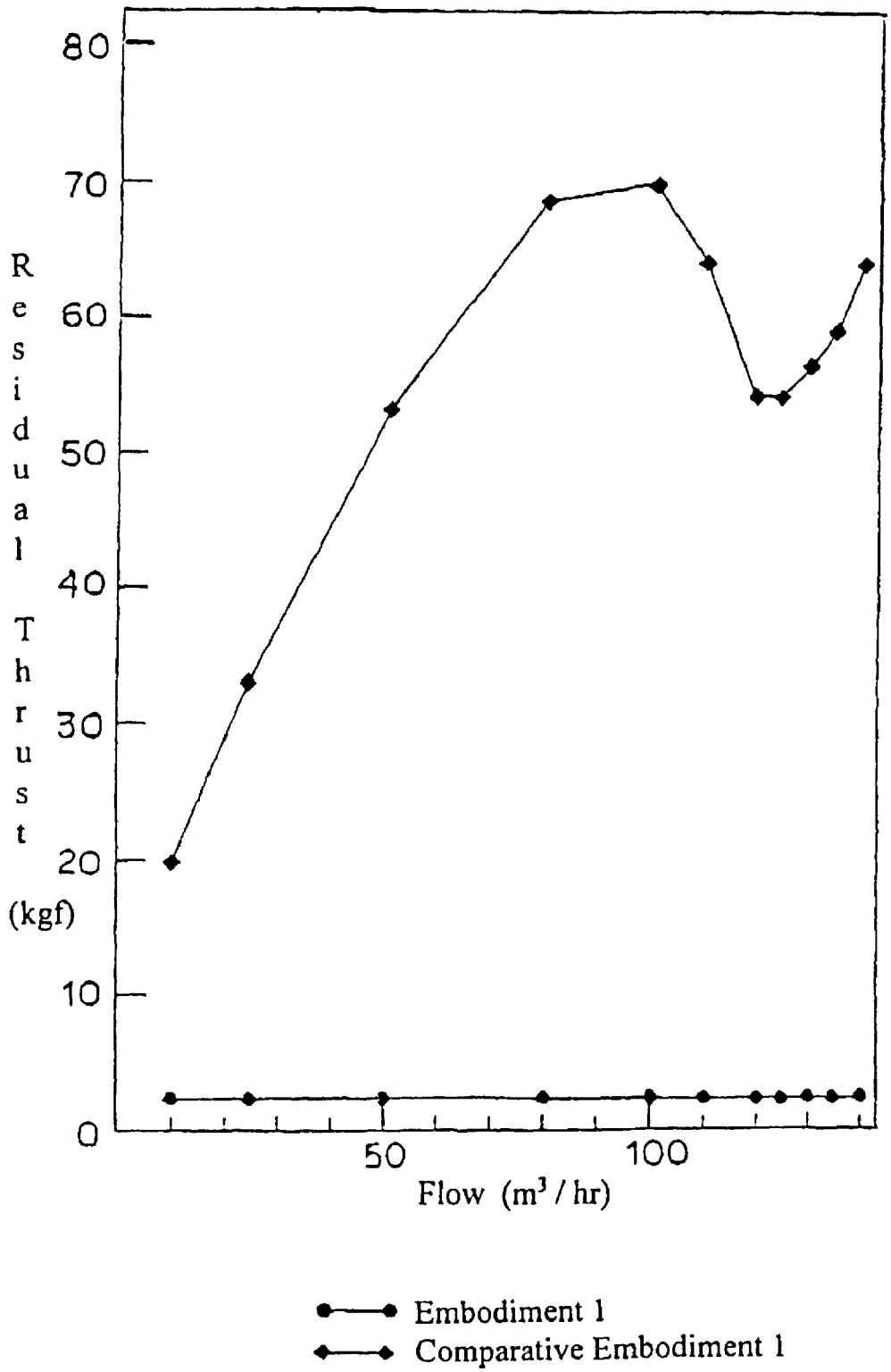
FIG. 5 is a line graph showing the change in residual thrust over a range of discharge flows for a canned motor pump having the thrust balance device of the present invention vs. a canned motor pump without the thrust balance device of the present invention.

Referring to FIG. 5, the results of the above measurements are shown. With a discharge flow of 10–140 $m^3$/hr, the canned motor pump described above shows almost no residual thrust. The fluid pressure inside thrust balance chamber 15 and the discharge pressure toward impeller 6 are substantially in equilibrium.

Comparative Embodiment 1

A canned motor pump (type: HN25E-F4) has a similar structure to that of Embodiment 1, except that ring-shaped groove 17 and pressure-equalizing sections 18 are omitted. Residual thrust is measured under the same conditions as in Embodiment 1.

Referring again to FIG. 5, the canned motor pump of the comparative embodiment generated a maximum residual thrust of approximately 70 kgf from the thrust balance chamber to impeller 6.

The present invention provides a thrust balance device having superior thrust balance properties. Furthermore, the present invention provides a thrust balance device having good thrust balance properties, regardless of the discharge from the pump. The present invention also provides a thrust balance device having good thrust balance properties, regardless of the speed of rotation of the impeller.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A thrust balance device in a centrifugal pump comprising:

a fixed orifice permitting flow of a portion of a fluid passing through said centrifugal pump into a thrust balance chamber of said thrust balance device;

said thrust balance chamber minimizing axial displacement of an impeller of said centrifugal pump;

a variable orifice permitting a variable flow of said portion from said thrust balance chamber depending on a balance between a fluid pressure between said thrust balance chamber and a fluid being pumped; and means for introducing a second fluid, having substantially no angular momentum, into said thrust balance chamber, whereby said second fluid facilitates flow of said portion and second fluid through said variable orifice.

2. A thrust balance device according to claim 1, wherein:

said means includes a plurality of pressure-equalizing sections connected to at least one stationary flow channel;

said at least one stationary flow channel having an opening to permit flow of said second fluid into said thrust balance chamber.

3. A thrust balance device according to claim 2, wherein said at least one stationary flow channel is a ring shaped groove.

4. A thrust balance device according to claim 3, wherein an upper perimeter surface and a lower perimeter surface of said ring shaped groove are parallel.

5. A thrust balance device according to claim 3, wherein an upper perimeter surface and a lower perimeter surface of said ring shaped groove are wedge shaped.

6. A thrust balance device according to claim 3, wherein:

each of said plurality of pressure-equalizing sections having a circular cross section;

each of said circular cross sections having a cross-sectional area;

a sum of each of said cross-sectional areas being smaller than an area of said opening of said ring-shaped groove.

7. A thrust balance device according to claim 6, further comprising:

a balance hole communicating between said thrust balance chamber and a fluid being pumped;

said sum is greater than an area of an opening of said balance hole; and said area of said opening of said ring-shaped groove is greater than said area of said opening of said balance hole.

8. A thrust control device for controlling an axial position of an impeller of a centrifugal pump, comprising:

said impeller having a first surface exposed to a pressure of a fluid being pumped;

a thrust balance chamber adjacent a second surface of said impeller;

at least one balance hole communicating between said first and second surfaces;

a projection facing said at least one balance hole;

a fixed orifice permitting a controlled leakage of said fluid from an outlet of said pump into said thrust balance chamber;

said projection being positioned to block communication between said first and second surfaces when said impeller is displaced axially a predetermined distance in a first direction, whereby said controlled leakage is enabled to increase a fluid pressure in said thrust balance chamber, and thereby to resist axial displacement of said impeller in said first direction; and at least one stationary flow channel conveying a portion of said fluid with substantially reduced angular momentum to said thrust balance chamber.

9. A thrust control device according to claim 8, wherein said at least one stationary flow channel is a ring shaped groove.

10. A thrust balance device according to claim 9, wherein an upper perimeter surface and a lower perimeter surface of said ring shaped groove are parallel.

11. A thrust balance device according to claim 9, wherein an upper perimeter surface and a lower perimeter surface of said ring shaped groove are wedge shaped.

12. A device for feeding fluid having substantially no angular velocity to a balance chamber of a centrifugal pump comprising:

a radially arranged opening for accepting said fluid at a larger radius and conducting said fluid to a smaller radius;

said radially arranged opening having a first cross-sectional area;

an outlet receiving said fluid at said smaller radius, and feeding said fluid into said balance chamber;

said outlet having a second cross-sectional area at its outlet to said balance chamber; and said first cross-sectional area being less than said second cross-sectional area.

* * * * *